US006701116B1

(12) United States Patent
Aoki

(10) Patent No.: US 6,701,116 B1
(45) Date of Patent: Mar. 2, 2004

(54) IMAGE FORMING APPARATUS

(75) Inventor: Shinji Aoki, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/234,705

(22) Filed: Sep. 5, 2002

(51) Int. Cl.[7] ..... G03G 15/01

(52) U.S. Cl. ..... 399/298; 399/55; 399/56; 399/46; 399/302

(58) Field of Search ..... 399/298, 299, 399/223, 302, 303, 38, 46, 51, 55, 56; 430/47

(56) References Cited

U.S. PATENT DOCUMENTS 5,627,629 A * 5/1997 Takahashi et al. ..... 399/231
6,389,260 B1 5/2002 Kataoka et al.

FOREIGN PATENT DOCUMENTS

JP 9-281768 A 10/1997
JP 2001-209232 A 8/2001

* cited by examiner

*Primary Examiner*—Hoang Ngo
(74) *Attorney, Agent, or Firm*—Foley & Lardner

(57) ABSTRACT

A quadruple-tandem type image forming apparatus in which four units of an image forming unit are disposed, and toner images are transferred to a transfer material sequentially, wherein supposing that surface potentials of a photosensitive body in each image forming unit are V0a, V0b, V0c, V0d from upstream in a moving direction of a transfer material toward downstream, development bias voltages in each image forming unit are VBa, VBb, VBc, VBd, and electrification quantities of a toner in each developing unit in each image forming unit are qa. qb, qc, qd, the relations of $V0a \geqq V0b \geqq V0c \geqq V0d$, $VBa \geqq VBb \geqq VBc \geqq VBd$, and $qa \geqq qb \geqq qc \geqq qd$ (wherein $V0a > V0d$, $VBa > VBd$, $qa > qd$) are fulfilled.

12 Claims, 6 Drawing Sheets

IMAGE FORMING APPARATUS

BACKGROUND OF THE INVENTION

1. Field of the Invention

The present invention relates to a quadruple-tandem type image forming apparatus employed for an electrophotographic process copying machine, a printer or the like.

2. Related Art Statement

FIG. 1 is a sectional view of a general quadruple-tandem type image forming apparatus, and printing operation of a color image will be explained with reference to FIG. 1. Here, as photosensitive body drums 103*a*~103*d*, OPC (Organic Photo Conductor) is employed.

The image forming steps in an image forming unit al will be explained. First, the surface of a photosensitive body drum 103*a* is uniformly charged in minus (−) by a scorothoron charger 105*a*. An exposure device not shown is disposed downstream of the scorothoron charger 105*a*, and exposure in conformity with image information is applied to the charged photosensitive body 103*a* to thereby form an electrostatic latent image. A 2-component developing unit 109*a* for encasing a yellow developer is disposed downstream of the exposure device, an electrostatic latent image is reversal-developed by a yellow toner, and a toner image is formed on the photosensitive body 103*a*.

On the other hand, a sheet of paper P as a transfer material are supplied from a paper cassette not shown and conveyed, and paper P is then transported onto a conveying belt 111 by an aligning roller 114 adjusting to a timing at which a toner image is formed on the photosensitive body 103*a*. A bias voltage (+) reversed in polarity to a charge polarity of a toner is applied by a DC power supply 127*a* to a transfer roller 123*a*, and a toner image on the photosensitive body 103*a* is transferred onto paper P by a transfer electric field formed between the photosensitive body 103*a* and the transfer roller 123*a*.

Here, a partial toner (a residual transfer toner) remained on the photosensitive body 103*a* without being transferred completely on paper P is cleaned by a photosensitive body cleaner 120*a*, and is sent as a waste toner to a waste toner box not shown. The cleaned surface of the photosensitive body 103*a* is exposed by an eliminator 121*a* and thereby eliminated, after which the steps of charge, exposure and development are repeated.

Also in image forming units b1, c1 and d1, a toner image is formed by the process similar to that mentioned above adjusting to a timing at which the toner image is formed in the image forming unit a1, and toner images of magenta, cyan, and black formed on the photosensitive bodies 103*b*, 103*c*, and 103*d* of the image forming units b1, c1 and d1 are also sequentially transferred onto paper P conveyed by the conveying belt 111. Generally, there is no uniformity in relation between an charge potential of a photosensitive body of each image forming unit, an charge quantity of toner, and a development potential.

A fixing unit not shown for fixing a toner on paper P is disposed downstream of the conveying belt 111, and paper P is caused to pass through the fixing unit to obtain a fixed image.

As described above, in the transfer step, a toner on the photosensitive body is transferred to a transfer material by a transfer electric field generated between the photosensitive body and the transfer roller, but there poses a problem in that where the transfer electric field is large, there occurs a so-called reversal transfer phenomenon in which the toner once transferred to the transfer material is returned to the photosensitive body again.

As the procedure for suppressing such a reversal transfer phenomenon as described, there has been proposed a procedure described in Japanese Patent Application Laid-Open No. 209232/2001 in which the charge quantity of toner downstream in a moving direction is set to be lower than the charge quantity of toner upstream, and a transfer bias voltage is set to be lower closer to the downstream. However, even if the transfer bias voltage is the same, a tendency of the reversal transfer is changed by a surface potential of the photosensitive body, as illustrated in the embodiment described later, from which it is said that generally, a grade need not be provided relative to the charge quantity of toner or the transfer bias voltage, and further, there is a disadvantage that a variation in reproducibility or gradient of dots of a color toner occurs by the mere provision of a grade relative to the charge quantity of toner.

Further, there has been also proposed a procedure described in Japanese Patent Application Laid-Open No. 209232/2001 in which a development potential in toner image forming means downstream is set to be lower than that upstream, and |VL−Vbias| is made smaller closer to downstream to thereby make electrostatic attracting force exerted between a toner of reversal polarity and the photosensitive body small. However, also in this respect, as illustrated in the embodiment described later, a development contrast or a development quantity of toner is not directly related to the reversal transfer, and in addition, there is a problem also that a variation in reproducibility or gradient of dots of a color toner occurs by the mere provision of a grade relative to the development potential.

With respect to such a reversal transfer phenomenon as described, the inventor thought that it resulted from a Pachen-discharge generated in the vicinity of a transfer region because of the fact that where a difference between a potential (normally, an earth potential) at the back of the photosensitive body or an charge potential of the surface of the photosensitive body and the effective value of a transfer bias voltage is large, the above-described phenomenon occurs often, and that an charge quantity of toner on the transfer material after having passed through the transfer region increases than that prior to the passage whereas an charge quantity of the reversal transfer toner considerably lowers (becoming+polarity).

Therefore, preferably, the transfer electric field is controlled so as not to generate the Pachen-discharge in order to suppress the reversal transfer. As means for controlling the transfer electric field, there have been generally known a method for controlling the transfer bias voltage itself, and a method for, before transferring a toner on the photosensitive body to a transfer material, exposing it to lower a potential of the surface of the photosensitive body (elimination before transfer) to lower a transfer electric field. However, by merely setting the transfer bias voltage to be lower, the reversal transfer can be reduced but the residual transfer increases, and the transfer efficiency is lowered, posting a problem in reproducibility of an image. Further, in case of elimination before transfer, the reversal transfer can be reduced, but there poses a problem that when a charge on the photosensitive body disappears, Coulomb repulsion force caused by toners is affected to increase dusts on the image.

Setting an charge potential of the photosensitive body lower is also one means for suppressing the reversal transfer, but there is a problem that when the charge potential of the photosensitive body is set to be lower, an image concentration lowers or a reproducibility or gradient of dots lowers also according to the charge quantity of toner or development bias voltage.

In a so-called photosensitive body cleanerless system in which a cleaner for cleaning a toner on the photosensitive body is not disposed but cleaning is carried out simultaneously with development by a developing unit, a toner remained on the photosensitive body without being transferred to a transfer material (a residual transfer toner) can be recovered into the developing unit, thus providing the merit that a waste toner can be reduced, and the service life of the photosensitive body extends, whereas there is a great problem that when the reversal transfer phenomenon occurs simultaneously in a plurality of colors of toners, toners are mixed in color within the developing unit, and such a method as described is not practically used in the quadruple-tandem type image forming apparatus.

SUMMARY OF THE INVENTION

The present invention has been accomplished in view of the problem noted above with respect to prior art, and an object of the invention is to provide a quadruple-tandem type image forming apparatus capable of securing the reproducibility or gradient of image dots of colors and image concentration simultaneously with the reduction in reversal transfer.

It is a further object of the invention to provide a quadruple-tandem type image forming apparatus which employs a photosensitive body cleanerless process in consideration of the environment, capable of preventing mixing of colors of toners by reducing a reversal transfer, reducing a waste toner and extending the service life of the photosensitive body while securing the reproducibility or gradient of image dots of colors and image concentration.

For achieving the aforementioned objects, according to the present invention, there is provided a quadruple-tandem type image forming apparatus, disposing four units of an image forming unit comprising: a photosensitive body, an charger for charging the photosensitive body to a prescribed potential, an exposure device for forming an electrostatic latent image on the photosensitive body, and a developing unit for forming a toner image on the photosensitive body, the toner images being transferred to a transfer material sequentially, characterized in that supposing that surface potentials of the photosensitive body in each image forming unit are V0a, V0b, V0c, V0d from upstream toward downstream in a transfer material moving direction, development bias voltages in each image forming unit are VBa, VBb, VBc, VBd, and charge quantities of toners in the developing units in each image forming unit are qa, qb, qc, qd, the following relation is fulfilled:

$$V0a \geqq V0b \geqq V0c \geqq V0d$$

$$VBa \geqq VBb \geqq VBc \geqq VBd$$

$$qa \geqq qb \geqq qc \geqq qd$$

(wherein V0a>V0d, VBa>VBd, qa>qd)

According to the present invention, there is further provided a quadruple-tandem type image forming apparatus, disposing four units of an image forming unit, comprising: a photosensitive body, an charger for charging the photosensitive body to a prescribed potential, an exposure device for forming an electrostatic latent image on the photosensitive body, and a developing unit for forming a toner image on the photosensitive body, employing a cleanerless system without disposing a cleaner for cleaning a toner on the photosensitive body and carrying out cleaning simultaneously with the development by the developing unit, the toner images being transferred to a transfer material sequentially, characterized in that supposing that surface potentials of the photosensitive body in each image forming unit are V0a, V0b, V0c, V0d from upstream toward downstream in a transfer material moving direction, development bias voltages in each image forming unit are VBa, VBb, VBc, VBd, and charge quantities of toners in the developing units in each image forming unit are qa, qb, qc, qd, the following relation is fulfilled:

$$V0a \geqq V0b \geqq V0c \geqq V0d$$

$$VBa \geqq VBb \geqq VBc \geqq VBd$$

$$qa \geqq qb \geqq qc \geqq qd$$

(wherein V0a>V0d, VBa>VBd, qa>qd).

DETAILED DESCRIPTION OF THE INVENTION

In the following, preferred embodiments of a quadruple-tandem type image forming apparatus according to the present invention will be explained in detail with reference to the accompanying drawings.

Embodiment 1

Figure 1:
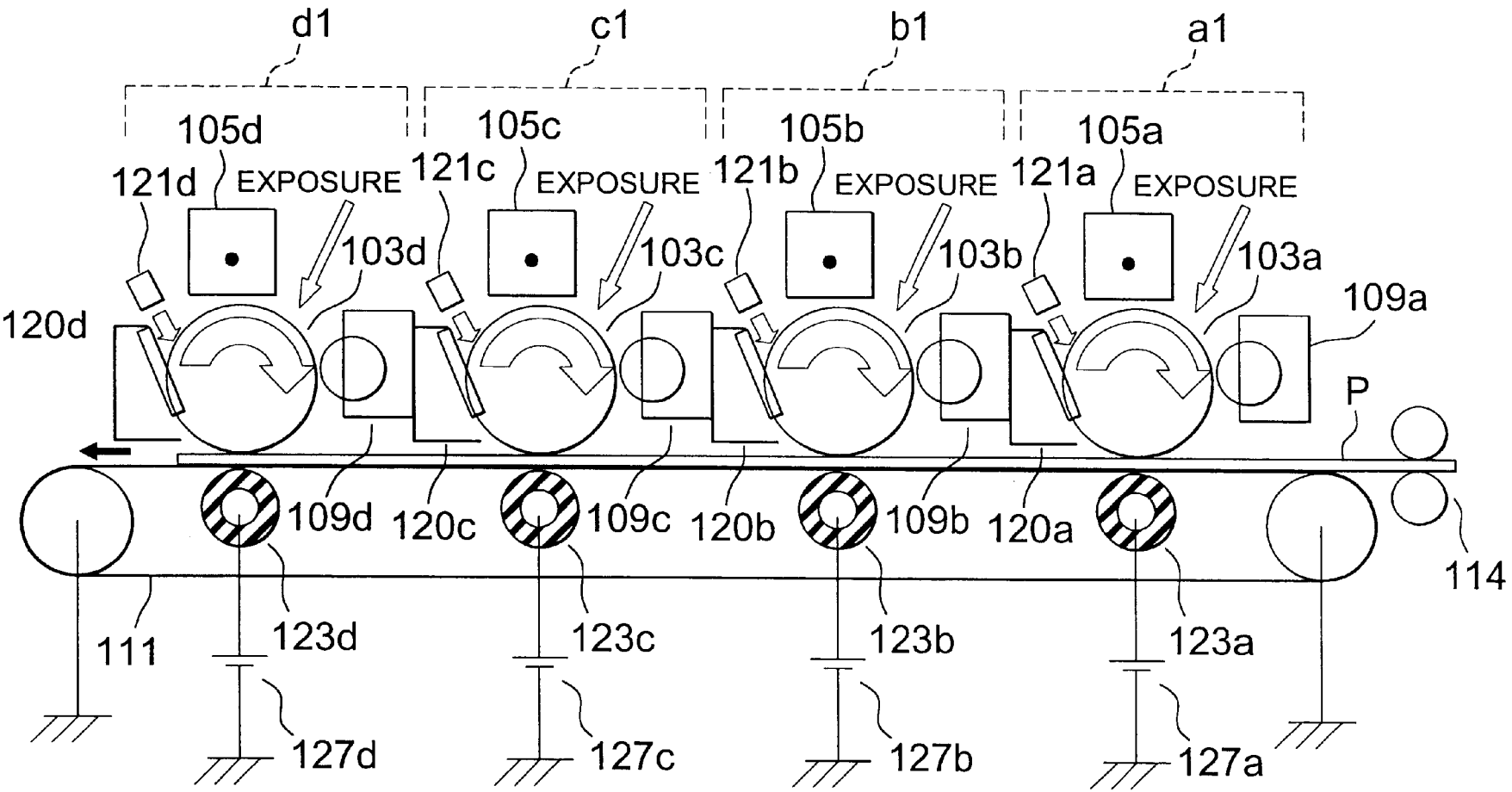
FIG. 1 a sectional view of a quadruple-tandem type image forming apparatus employing a direct transfer system to which the present invention is applied.

FIG. 1 is a sectional view of a quadruple-tandem type image forming apparatus employing a direct transfer system to which the present invention is applied.

Charge wires of scorothoron chargers 105*a*~105*d* are connected to a DC power supply not shown, and a grid bias voltage is controlled by the DC power supply. A diameter of photosensitive body drums 103*a*~103*d* is 30 mm. As a conveying belt 111, a polyimide belt having a thickness of 100 $\mu$m in which carbon is uniformly dispersed (electric resistance is $10^{10}$ Ωcm) is used, and as transfer rollers 123*a*~123*d*, a conductive foam urethane roller having a diameter of 18 mm in which carbon is uniformly dispersed (core diameter is 10 mm, and electric resistance between roller surfaces is approximately $10^{6}$ Ω) is used.

Table 1 shows one example of the printing conditions in image forming units of colors, that is, the photosensitive body surface potential, development bias voltage, toner charge quantity and transfer bias voltage.

TABLE 1

| | V0 [V] | VB [V] | q [$\mu$C/g] | Vtr [V] |
|---|---|---|---|---|
| a: Yellow | −450 | −330 | −20 | 1050 |
| b: Magenta | −350 | −260 | −15 | 950 |
| c: Cyan | −310 | −235 | −13 | 900 |
| d: Black | −255 | −195 | −10 | 850 |

Figure 2:
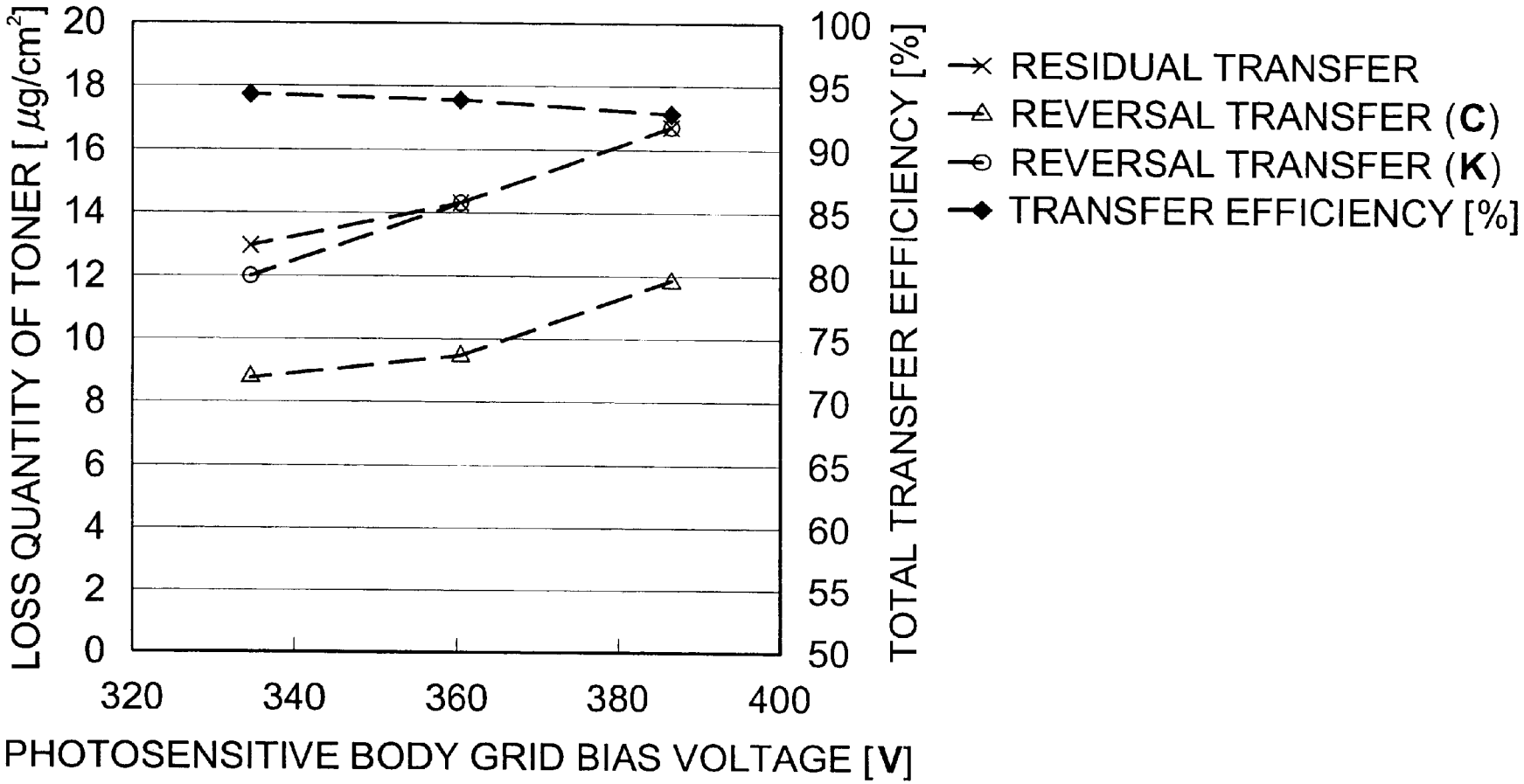
FIG. 2 is a graph showing a relation between the residual transfer, reversal transfer and transfer efficiency with respect to a photosensitive body grid bias voltage.

FIG. 2 shows, where a prescribed quantity (approximately 610 $\mu$g/cm$^2$) of a magenta (M) toner is developed on the photosensitive body drum 103*b*, and the developed the magenta (M) toner is transferred to paper, the dependability of the quantity of the magenta (M) toner to be lost during the time from the development to the transfer on the photosensitive body grid bias voltage. In FIG. 2, the symbol× indicates a quantity of toner remained on the photosensitive body drum 103*b*, the symbol Δ indicates a quantity of toner reversely transferred (reversal transfer (C)) to the photosensitive body drum 103*c* of a cyan image forming unit, the symbol ○ indicates a quantity of toner reversely transferred (reversal transfer (K)) to the photosensitive body drum 103*d* of a black image forming unit, and the symbol ● indicates a transfer efficiency calculated from the quantity of toner loss thereof (a quantity of toner transferred to paper/a quantity of toner developed).

With respect to the magenta (M) toner, a solid image is formed, and with respect to yellow (Y), cyan (C) and black (K), an image is not formed. The grid bias voltages of the photosensitive bodies of Y, M, C and K are the same, and the transfer bias voltages are a prescribed value 950 V. The magenta (M) toner used this time is a general crushed toner of an charge quantity −15 $\mu$C/g, but it has been assured that even other polymerization method toners, except that absolute values of the development quantity, loss quantity and transfer bias are different, have a similar tendency.

It is understood from FIG. 2 that as the grid bias voltage of the photosensitive body is set higher, the quantities of the residual transfer toner and reversal transfer toner increase. This is assumed because of the fact that as previously explained, when the surface potential of the photosensitive body is higher, the Pachen discharge easily occurs. The inclination of the toner loss caused by the residual transfer is about the same in degree as that of the toner loss caused by the reversal transfer. However, it is understood that in case of the magenta (M) toner, since the reversal transfer occurs over twice, the cyan image forming unit and the black image forming unit, if the photosensitive body grid bias voltage is set to be low, the transfer efficiency becomes high. It is understood that in the quadruple-tandem type image forming apparatus, since with respect to the yellow toner, there are three times of a chance that the reversal transfer occurs, and with respect to the C toner, once thereof, the reversal transfer is well suppressed advantageously in terms of transfer efficiency as well as in terms of image quality, and therefore, it is necessary to make a surface potential of the photosensitive body downstream in a moving direction of a transfer material lower.

Figure 3:
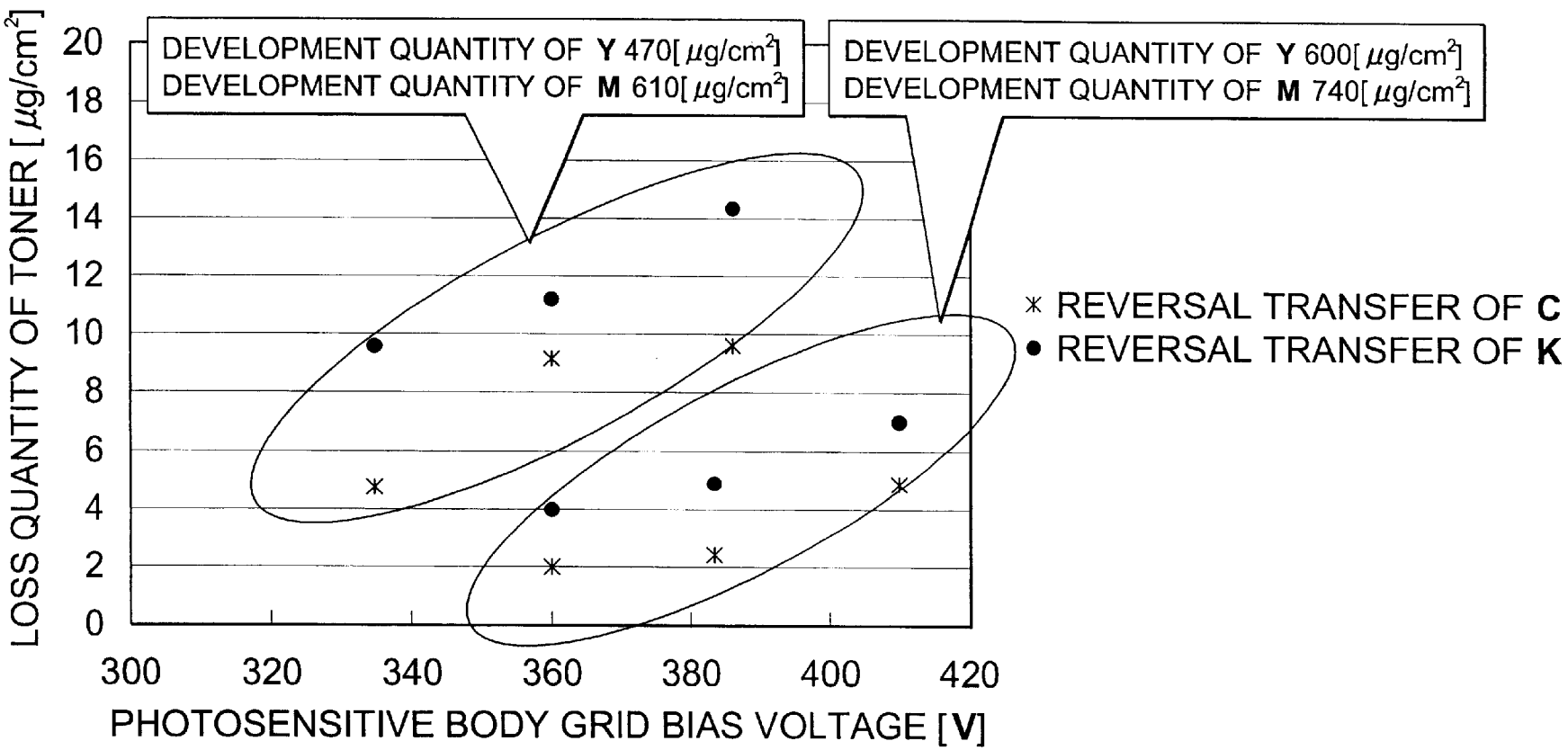
FIG. 3 is a graph showing a relation between the development quantity and reversal transfer of yellow and magenta toners with respect to a photosensitive body grid bias voltage.

FIG. 3 shows that where a solid image of yellow (Y) toner is formed on which is formed a solid image of magenta (M) toner, the dependability of the loss quantity of the magenta (M) toner on the photosensitive body grid bias voltage is investigated by changing development quantities of Y and M toners (development contrast). In FIG. 3, the symbol× indicates a quantity of toner reversely transferred (reversal transfer (C)) to the photosensitive body drum 103*c* of the cyan image forming unit, and the symbol ● indicates a quantity of toner reversely transferred (reversal transfer (K)) to the photosensitive body drum 103*d* of the black image forming unit.

It is understood from FIG. 3 that the reversal transfer quantity of the magenta (M) toner is less when the development quantity of the yellow (Y) toner is much, in either the cyan image forming unit or the black image forming unit, and has nothing to do with a degree of the development quantity of the magenta (M) toner. This suggests that an electric charge of the yellow (Y) toner already present on paper before the magenta (M) toner is transferred causes a transfer electric field to strain, as a result of which the Pachen discharge is hard to occur, and therefore, it is necessary to increase the total charge quantity of toner upstream in a moving direction of a transfer material.

From the above-described results, it is necessary for realizing the high transfer efficiency and low reversal transfer, in the quadruple-tandem type image forming apparatus, to fulfill the following relation, supposing that surface potentials of photosensitive bodies in image forming units a~d, are V0a, V0b, V0c, V0d, and development bias voltages in image forming units are VBa, VBb, VBc, VBd, $$V0a \geqq V0b \geqq V0c \geqq V0d$$

$$VBa \geqq VBb \geqq VBc \geqq VBd$$

(wherein V0a>V0d, VBa>VBd)

However, if the charge quantity of each color toner is constant, a layer thickness at the time of solid printing with respect to each color is varied, or the reproducibility or gradient of dots is varied. For example, when a toner of high charge quantity is developed under the conditions that the photosensitive body surface potential is high, and at the same time, the development bias voltage is low, not only the layer thickness at the time of solid printing is thin but also the gradient is defective to make the reproduction of 1 dot difficult. So, the securing of image quality was realized by $$qa \geqq qb \geqq qc \geqq qd$$

(wherein qa>qd)

when the charge quantities of toners are qa, qb, qc, qd.

It is noted that since the reversal transfer is also affected by the transfer bias voltage, in the present embodiment, when transfer bias voltages are Vtra, Vtrb, Vtrc, Vtrd, the following relation was provided, $$Vtra \geqq Vtrb \geqq Vtrc \geqq Vtrd$$

However, with respect to the transfer bias voltage, it is not always necessary to fulfill the relation as noted above. However, with respect to Vtra, it is desired that the effective value is set to 1000 V or above, and the Pachen discharge is positively caused to occur thereby electrostatic adsorbing paper on the conveying belt. With this, paper on the conveying belt can be conveyed securely.

Further, in the present embodiment; while as the conveying belt 111, a polyimide belt whose electric resistance value is $10^{10}$ Ωcm was used, it is noted that a belt formed of a semiconductive material whose electric resistance value is $10^8$~$10^{13}$ Ωam may be used, and also as transfer means, a conductive brush, a conductive rubber blade, a conductive sheet or the like may be used not limiting to a transfer roller.

Embodiment 2

Figure 4:
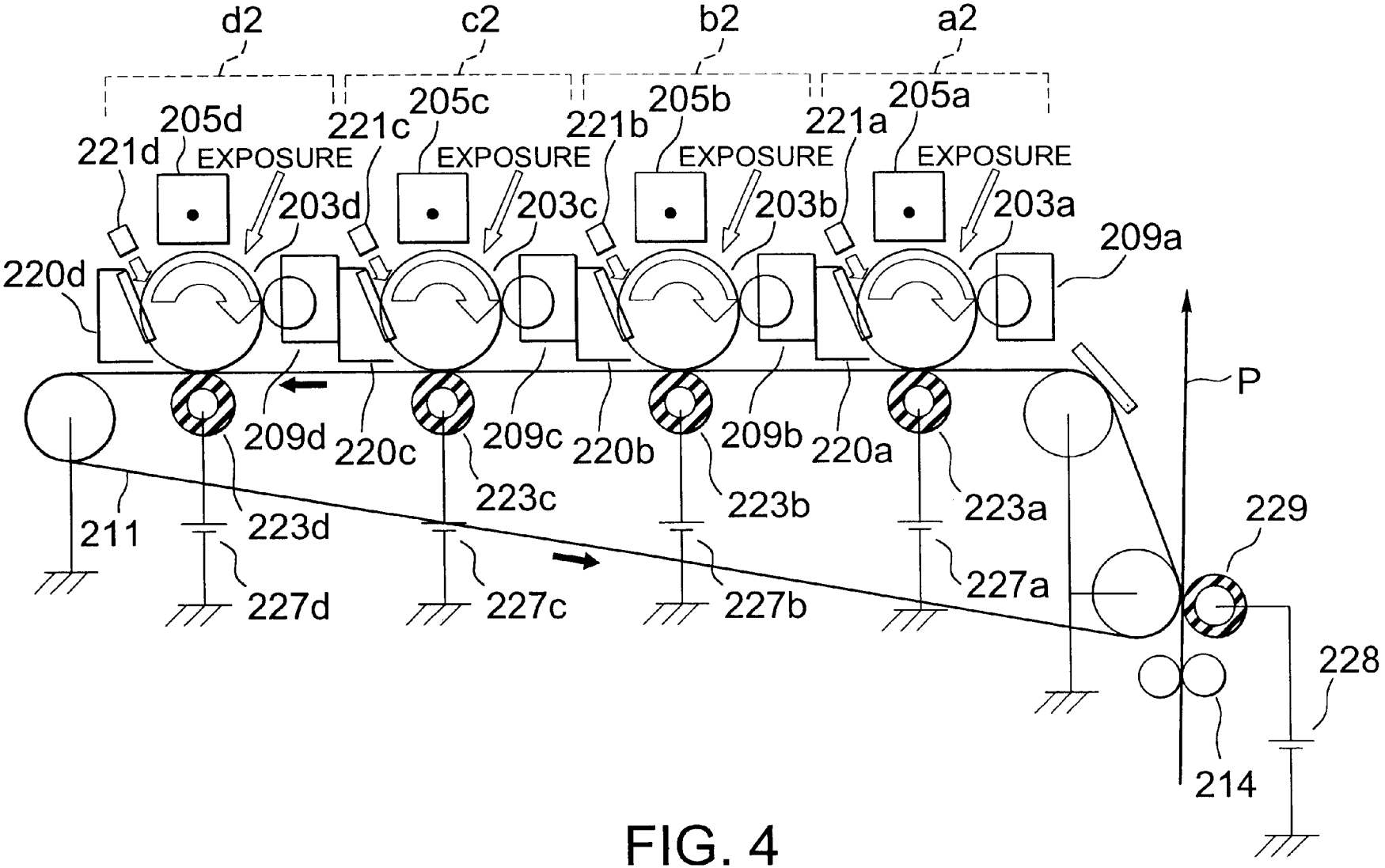
FIG. 4 is a sectional view of a quadruple-tandem type image forming apparatus employing an intermediate transfer system to which the present invention is applied.

FIG. 4 is a sectional view of a quadruple-tandem type image forming apparatus employing an intermediate transfer system to which the present invention is applied.

The image forming apparatus of Embodiment 1 employs a so-called direct transfer system in which a toner image on the photosensitive body is transferred directly to paper, but the image forming apparatus according to the present embodiment employs an intermediate transfer system in which toner images of four colors are once transferred to a semiconductive intermediate transfer body, and thereafter, transferred collectively to paper. Therefore, in case of the present embodiment, a transfer material to which is transferred a toner image from an image forming unit is an intermediate transfer body.

Table 2 shows one example of the printing conditions in the image forming units of colors, that is, the photosensitive body surface potential, development bias voltage, toner charge quantity and transfer bias voltage, but a semiconductive intermediate transfer belt is used whereby a primary transfer bias voltage can be set to be lower, and occurrence of a reversal transfer can be suppressed as compared with the direct transfer system.

TABLE 2

| | V0 [V] | VB [V] | q [μC/g] | Vtr [V] |
|---|---|---|---|---|
| a: Yellow | −450 | −330 | −20 | 620 |
| b: Magenta | −350 | −260 | −15 | 560 |
| c: Cyan | −310 | −235 | −13 | 530 |
| d: Black | −255 | −195 | −10 | 330 |

It is noted that since the Pachen discharge can be made approximately zero when the effective value of the transfer bias voltage is set to 330 V or less, the effective value of the transfer bias voltage is set to 330 V or less where the reversal transfer is suppressed to minimum. Particularly, it is desirable that with respect to the black image forming unit, the effective value is set to 330 V or less.

A polyimide belt having a thickness of 100 μm in which carbon is uniformly dispersed (electric resistance is $10^{10}$ Ωcm), a conductive foam urethane roller having a diameter of 18 mm in which carbon is uniformly dispersed (core diameter is 10 mm, and electric resistance between roller surfaces is approximately $10^{10}$ Ωcm), and a conductive foam urethane roller having a diameter of 20 mm in which carbon is uniformly dispersed (core diameter is 12 mm, and electric resistance between roller surfaces is approximately $10^{6}$ Ωcm) were used as an intermediate transfer belt 211, primary transfer rollers 223*a*~223*d*, and a secondary transfer roller 228, respectively.

Further, a belt formed of a semiconductive material whose electric resistance value is $10^{8}$~$10^{13}$ Ωcm may be used as an intermediate transfer belt 211, and as transfer means, a conductive brush, a conductive rubber blade, a conductive sheet or the like may be used.

Embodiment 3

Figure 5:
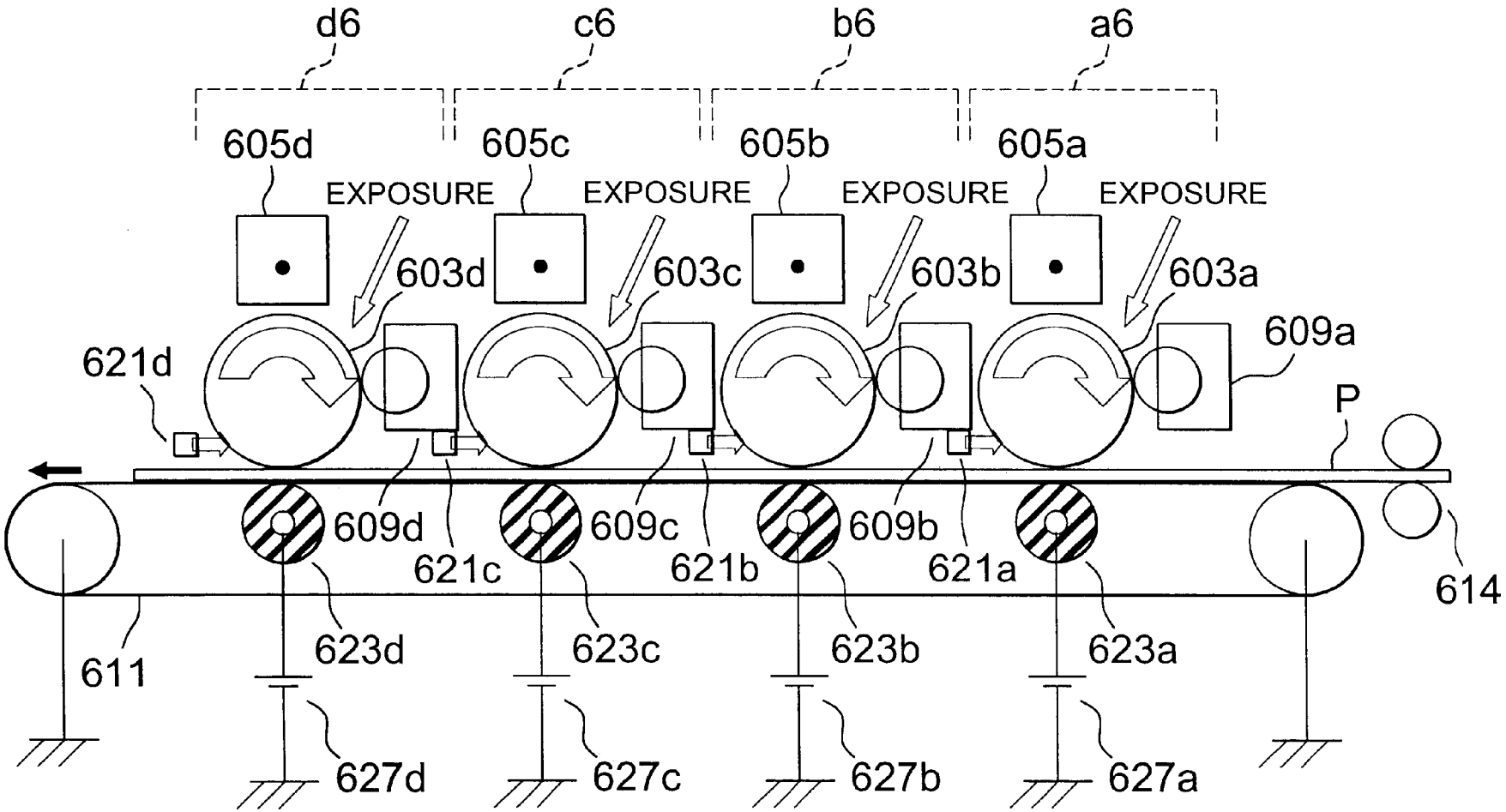
FIG. 5 is a sectional view of a quadruple-tandem type image forming apparatus employing a direct transfer system and a cleanerless process to which the present invention is applied.

FIG. 5 is a sectional view of a quadruple-tandem type image forming apparatus employing a direct transfer system and a cleanerless process to which the present invention is applied. Printing operation of a color image will be explained with reference to FIG. 5. Here, as photosensitive body drums 603*a*~603*d*, an OPC (Organic Photo Conductor) is employed.

An image forming step in an image forming unit a6 will be explained. First, the surface of the photosensitive body drum 603*a* is uniformly charged in minus (−) by a scorothoron charger 605*a*. An exposure device not shown is disposed downstream of the scorothoron charger 605*a*, and exposure adapted to image information is carried out with respect to the charged photosensitive body drum 603*a* to thereby form an electrostatic latent image. A 2-component developing unit 609*a* for encasing a yellow developer is disposed downstream of the exposure device, the electrostatic latent image is reversely developed by a yellow toner, and a toner image is formed on the photosensitive body drum 603*a*.

On the other hand, paper P as a transfer material is supplied from a sheet cassette not shown and conveyed, and paper P is transported onto a conveying belt 611 by an aligning roller 614 adjusting to a timing at which a toner image is formed on the photosensitive body 603*a*. A bias voltage (+) reversed in polarity to the charge polarity of a toner is applied to a transfer roller 623*a* by a DC power supply 627*a*, and a toner image on the photosensitive body drum 603*a* is transferred to paper P by a transfer electric field formed between the photosensitive body 603*a* and the transfer roller 623*a*.

A partial toner (a residual transfer toner) remained on the photosensitive body drum 603*a* without being transferred completely to paper P passes through an eliminator 621*a*, and thereafter, charged and exposed, as described above, and cleaned simultaneously with development by a 2-component developing unit 609*a*.

Also in image forming units b6, c6 and d6, a toner image is formed by a process similar to that previously mentioned adjusting to a timing at which a toner image is formed in the image forming unit a6, and toner images of magenta, cyan, and black formed on photosensitive bodies 603*b*, 603*c*, and 603*d* of the image forming units b6, c6, and d6 are also transferred sequentially on paper P conveyed by the conveying belt 611.

A fixing unit not shown for fixing a toner on paper P is disposed downstream of the conveying belt 611, and paper P passes through the fixing unit to obtain a fixed image.

Charge wires of scorothoron chargers 605*a*~605*d* are connected to a DC power supply not shown, and a grid bias voltage is controlled by the DC power supply. A diameter of the photosensitive body drums 603*a*~603*d* is 30 mm. As the conveying belt 611, a polyimide belt having a thickness of 100 μm in which carbon is uniformly dispersed (electric resistance is $10^{10}$ Ωcm) is used, and as the transfer rollers 623*a*~623*d*, a conductive foam urethane roller having a diameter of 18 mm in which carbon is uniformly dispersed (core diameter is 10 mm, and electric resistance between roller surfaces is approximately $10^{6}$ Ω) is used.

Table 3 shows one example of the printing conditions in the image forming units of colors, that is, the surface potential of the photosensitive body, development bias voltage, toner charge quantity and transfer bias voltage.

TABLE 3

| | V0 [V] | VB [V] | q [μC/g] | Vtr [V] |
|---|---|---|---|---|
| a: Yellow | −450 | −330 | −20 | 1050 |
| b: Magenta | −350 | −260 | −15 | 950 |

TABLE 3-continued

| | V0 [V] | VB [V] | q [μC/g] | Vtr [V] |
|---|---|---|---|---|
| c: Cyan | −310 | −235 | −13 | 900 |
| d: Black | −255 | −195 | −10 | 850 |

With respect to transfer bias voltage values Vtra, Vtrb, Vtrc, Vtrd, the following relation is desirable in order to suppress the reversal transfer which poses a greatest problem in the cleanerless process, $$Vtra \geqq Vtrb \geqq Vtrc \geqq Vtrd$$

With respect to Vtra, if the effective value is set to 1000 V or above so as to cause Pachen discharge to occur positively, paper is electrostatically adsorbed on the conveying belt 611, and paper on the conveying belt 611 can be conveyed accurately.

As the conveying belt 611, a belt formed of a semiconductive material whose electric resistance value is $10^8$~$10^{13}$ Ωcm may be used, and as the transfer means, a conductive brush, a conductive rubber blade, a conductive sheet or the like may be used not limiting to a transfer roller.

The reversal transfer is effectively suppressed under the above-described conditions to suppress mixing of colors within the developing unit, as a result of which the cleanerless process could be realized in the quadruple-tandem type image forming apparatus. By the employment of the cleanerless process, the service life of the photosensitive body can be extended from conventional printing, 60,000 sheets, to present printing, 120,000 sheets, and in addition, with respect to the loss rate of toner, for example, in case of a single-color solid image of magenta toner, approximately 0 could be achieved from conventional approximately 8~9%. Further, it is understood that the influence on an output image caused by the residual transfer toner, and the cleaning property have no problem.

Embodiment 4

Figure 6:
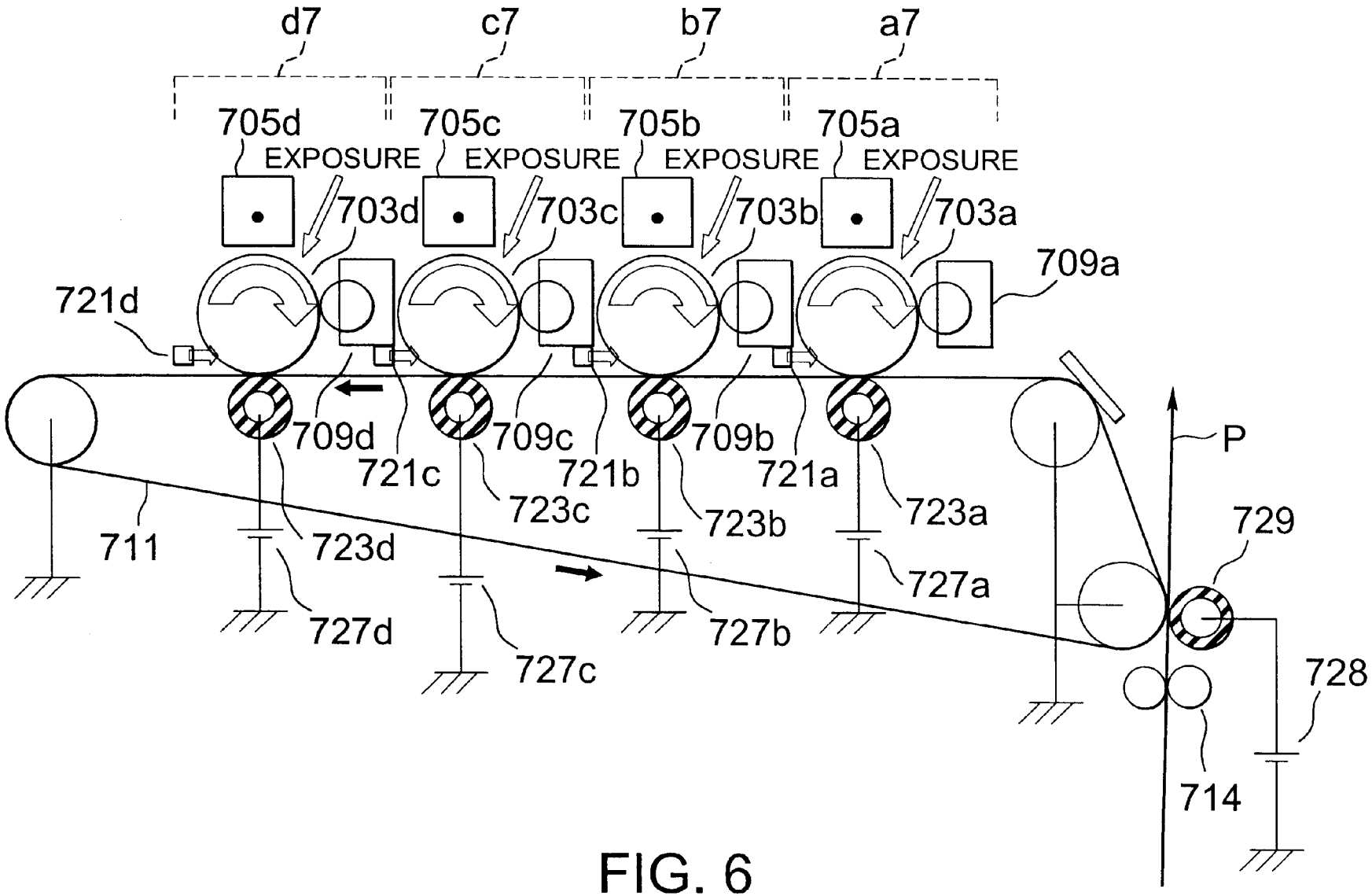
FIG. 6 is a sectional view of a quadruple-tandem type image forming apparatus employing an intermediate transfer system and a cleanerless process to which the present invention is applied.

FIG. 6 is a sectional view of a quadruple-tandem type image forming apparatus employing an intermediate transfer system and a cleanerless process to which the present invention is applied.

The image forming apparatus of Embodiment 3 employs the so-called direct transfer system in which a toner image on the photosensitive body is transfer directly to paper, whereas the image forming apparatus of the present embodiment employs an intermediate transfer system in which toner images of four colors are transferred once to a semiconductive intermediate transfer body and thereafter transferred collectively to paper. Therefore, in case of the present embodiment, a transfer material for transferring a toner image from an image forming unit is an intermediate transfer body.

Table 4 shows one example of the printing conditions in an image forming unit of colors, that is, the surface potential of the photosensitive body, development bias voltage, toner charge quantity and transfer bias voltage. By using a semiconductive intermediate transfer belt, a primary transfer bias voltage can be set to be lower, and occurrence of reversal transfer can be suppressed as compared with the direct transfer system.

The Pachen discharge can be made substantially zero when the effective value of a transfer bias voltage is set to 330 V or less, and where the reversal transfer is suppressed to minimum, the effective value of the transfer bias voltage is set to 330 V or less. Particularly, with respect to a black image forming unit, it is desired that the effective value is set to 330 V or less.

TABLE 4

| | V0 [V] | VB [V] | q [μC/g] | Vtr [V] |
|---|---|---|---|---|
| a: Yellow | −450 | −330 | −20 | 620 |
| b: Magenta | −350 | −260 | −15 | 560 |
| c: Cyan | −310 | −235 | −13 | 530 |
| d: Black | −255 | −195 | −10 | 330 |

What is claimed is:

1. A quadruple-tandem type image forming apparatus, disposing four units of an image forming unit comprising: a photosensitive body, a charger for charging the photosensitive body to a prescribed potential, an exposure device for forming an electrostatic latent image on the photosensitive body, and a developing unit for forming a toner image on the photosensitive body, the toner images being transferred to a transfer material sequentially, wherein surface potentials of the photosensitive body in each image forming unit are defined as V0a, V0b, V0c, V0d from upstream toward downstream in a moving direction of the transfer material, development bias voltages in each image forming unit are defined as VBa, VBb, VBc, VBd, and charge quantities of toners in the developing units in each image forming unit are defined as qa, qb, qc, qd, and the following relation is fulfilled:

$$V0a \geqq V0b \geqq V0c \geqq V0d$$

$$VBa \geqq VBb \geqq VBc \geqq VBd$$

$$qa \geqq qb \geqq qc \geqq qd$$

(wherein V0a>V0d, VBa>VBd, qa>qd), and wherein ratios of the surface potentials of the photosensitive body to the development bias voltages in each of the image forming units are substantially the same.

2. The image forming apparatus according to claim 1, wherein transfer means for transferring a toner image formed on the photosensitive body to the transfer material is disposed opposite the photosensitive body in each image forming unit, wherein transfer bias voltages applied to the transfer means are defined as Vtra, Vtrb, Vtrc, Vtrd from upstream in the moving direction of the transfer material toward downstream, and the following relation is fulfilled:

$$Vtra \geqq Vtrb \geqq Vtrc \geqq Vtrd.$$

3. The image forming apparatus according to claim 2, wherein at least the effective value of Vtra is 1000 V or above.

4. The image forming apparatus according to claim 1, wherein said transfer material is an intermediate transfer body.

5. The image forming apparatus according to claim 4, wherein transfer means for transferring a toner image formed on the photosensitive body to an intermediate transfer body is disposed opposite the photosensitive body in each image forming unit, wherein transfer bias voltages applied to the transfer means are defined as Vtra, Vtrb, Vtrc, Vtrd from upstream in the moving direction of an intermediate transfer body toward downstream, and the following relation is fulfilled:

$$Vtra \geqq Vtrb \geqq Vtrc \geqq Vtrd.$$

6. The image forming apparatus according to claim 5, wherein at least the effective value of Vtrd is 300 V or less.

7. A quadruple-tandem type image forming apparatus, disposing four units of an image forming unit, comprising: a photosensitive body, a charger for charging the photosensitive body to a prescribed potential, an exposure device for forming an electrostatic latent image on the photosensitive body, and a developing unit for forming a toner image on the photosensitive body, employing a cleanerless system without disposing a cleaner for cleaning a toner on the photosensitive body and carrying out cleaning simultaneously with the development by the developing unit, the toner images being transferred to a transfer material sequentially, wherein surface potentials of the photosensitive body in each image forming unit are defined as V0a, V0b, V0c, V0d from upstream toward downstream in a moving direction of the transfer material, development bias voltages in each image forming unit are defined as VBa, VBb, VBc, VBd, and charge quantities of toners in the developing units in each image forming unit are defined as qa, qb, qc, qd, and the following relation is fulfilled:

$$V0a \geqq V0b \geqq V0c \geqq V0d$$

$$VBa \geqq VBb \geqq VBc \geqq VBd$$

$$qa \geqq qb \geqq qc \geqq qd$$

(wherein V0a>Vd, VBa>VBd, qa>qd), and wherein ratios of the surface potentials of the photosensitive body to the development bias voltages in each of the image forming units are substantially the same.

8. The image forming apparatus according to claim 7, wherein transfer means for transferring a toner image formed on the photosensitive body to the transfer material is disposed opposite the photosensitive body in each image forming unit, wherein transfer bias voltages applied to the transfer means are defined as Vtra, Vtrb, Vtrc, Vtrd from upstream in the moving direction of the transfer material toward downstream, and the following relation is fulfilled:

$$Vtra \geqq Vtrb \geqq Vtrc \geqq Vtrd.$$

9. The image forming apparatus according to claim 8, wherein at least the effective value of Vtra is 1000 V or above.

10. The image forming apparatus according to claim 7, wherein said transfer material is an intermediate transfer body.

11. The image forming apparatus according to claim 10, wherein transfer means for transferring a toner image formed on the photosensitive body to an intermediate transfer body is disposed opposite the photosensitive body in each image forming unit, wherein transfer bias voltages applied to the transfer means are defined as Vtra, Vtrb, Vtrc, Vtrd from upstream in the moving direction of the intermediate transfer body toward downstream, and the following relation is fulfilled:

$$Vtra \geqq Vtrb \geqq Vtrc \geqq Vtrd.$$

12. The image forming apparatus according to claim 11, wherein at least the effective value of Vtrd is 300 V or less.

* * * * *